United States Patent [19]

Strange

[11] 4,004,749

[45] Jan. 25, 1977

[54] ELECTROGRAPHIC PRINTER PAPER TENSIONING DEVICE

[75] Inventor: Robert F. Strange, Round Rock, Tex.

[73] Assignee: Bausch & Lomb Incorporated, Rochester, N.Y.

[22] Filed: Oct. 28, 1975

[21] Appl. No.: 625,995

[52] U.S. Cl. ..... 242/75.4; 242/156.1

[51] Int. Cl.[2] ..... B65H 23/06; B65H 59/16

[58] Field of Search ..... 242/75.4, 75.94, 156.1; 226/195

[56] References Cited

UNITED STATES PATENTS

| | | | |
|---|---|---|---|
| 1,346,700 | 7/1920 | Carlsen | 242/75.4 |
| 1,526,087 | 2/1925 | Petersen | 242/75.4 X |

FOREIGN PATENTS OR APPLICATIONS

| | | | |
|---|---|---|---|
| 799,317 | 11/1968 | Canada | 242/75.4 |

*Primary Examiner*—Edward J. McCarthy
*Attorney, Agent, or Firm*—Frank C. Parker; Bernard D. Bogdon; DeWitt M. Morgan

[57] ABSTRACT

An electrographic printer employs a constant-force spring to provide a positive means of preventing slack from occurring in the distributed segment of recording material existing between the source and a drive roller powered by a stepper motor. Further, the constant-force spring prevents backlash and, in cooperation with holding devices, skewing from occurring in the distributed segment of recording material.

27 Claims, 7 Drawing Figures

ELECTROGRAPHIC PRINTER PAPER TENSIONING DEVICE

BACKGROUND OF THE INVENTION

1. Field of the Invention

The present invention is directed toward an electrographic printer having means to prevent slack, backlash and skewing from occurring in the distributed segment of recording material.

2. Description of the Prior Art

In the past various means have been used to properly tension the recording paper used in printers and plotters so that no slack, backlash or edge misalignment occurs between the paper source and a drive roller powered, for example, by a stepper motor. The stepper motor urges the paper through the various stages necessary, in the case of an electrographic printer, for electrically charging the paper during the printing operation. If, for any reason, slack or backlash occurs in the segment of paper located between the paper source and the drive roller, it becomes difficult to print characters of acceptable resolution. The characters that are printed, for example, can either be distorted at the start or finish of the printing operation, or both. The constant starting and stopping of the stepper motor causes extension and compression of the printed characters and thereby results in generally unsatisfactory printouts.

Further, if the paper becomes skewed to either side somewhere between, for example, the paper source and the stylus, or printing, area, and is allowed to remain skewed, the paper can wrinkle and/or tear. Of course, if the paper does wrinkle or tear, or both, it is useless and must be discarded. The printing process must then be repeated.

Various methods have been used in the past in attempts to deal with these problems, but they have generally only met with limited success. These methods have sometimes corrected one of the problems, but have only partially successful in correcting the others.

A further problem area in paper tensioning devices exists because of the different types and weights of recording paper which are widely used. One type is generally identified as roll paper, which is delivered from a rolled source. Another type is commonly called fan-fold and is generally delivered from a stacked source. Up to the time of this inventive contribution, there has been little success in devising a workable and inexpensive method of tensioning, removing backlash and edge-aligning which will work on either of these types of paper. The present invention, as set forth herein, provides a solution to the above-mentioned problems.

SUMMARY OF THE INVENTION

This invention provides a paper, or similarly used material, tensioning device for printers, particularly electrographic printers, which tensions, edge aligns and removes backlash from recording paper which may be of either the rolled or fan-fold variety. It does these things by providing a constant-force type of spring which engages the recording paper thereby exerting a constant and even tension thereon. In the case of rolled recording paper the tension force is exerted against the paper while the paper is still on the roll. If it is desirable to use paper of the fan-fold variety, a separate member appropriate to accommodate the instrument can assist in supporting the paper which, in the case of roller paper, is generally supported by the core of the rolled recording paper. Therefore, it is easily seen that the constant-force spring will provide satisfactory results by engaging either type of paper in much the same manner.

DETAILED DESCRIPTION OF THE PREFERRED EMBODIMENTS

Figure 1:
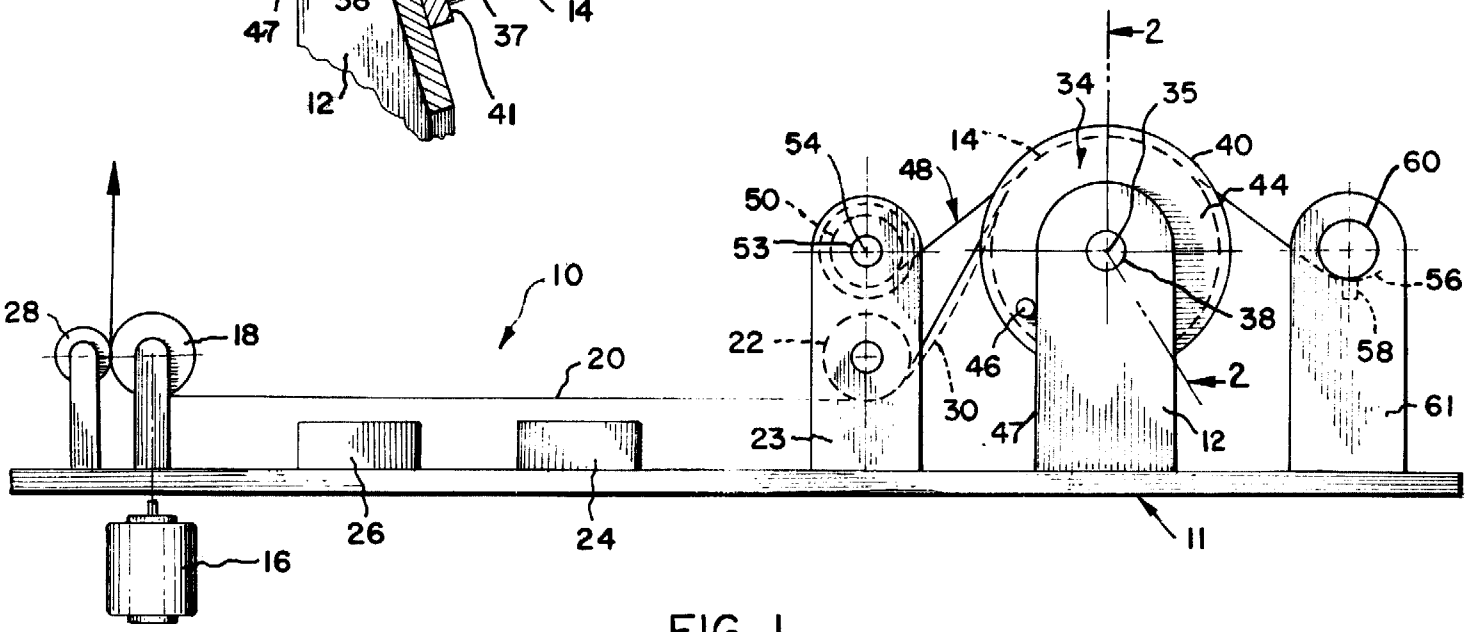
FIG. 1 is a schematic diagram of a paper tensioning device incorporated in a recording system according to the principles of the present invention.

A printer 10, as best seen in the schematic diagram of FIG. 1, has a base 11 and upright members 12 and 12' for supporting, typically, a roll of paper 14. A stepper motor 16 is preferably directly connected to a drive roller 18 which frictionally engages a length of chart paper 20. The chart paper 20 is payed out from the roll 14 and is driven through a typical electrographic recording system similar to the one illustrated in the block diagram of FIG. 1. Typical recording systems contemplated for use with the disclosed invention are illustrated in U.S. Pat. Nos. 3,108,534, 3,161,457, 3,653,065 and 3,702,922.

The length of distributed chart paper 20 engages, typically, a guide roller 22 which is supported by upright members 23 and 23' and then passes over a printing station, which in the case of an electrographic printer includes a stylus area 24 for printing and a toner station 26 for making visible the latent images printed at the printing station. This system is disclosed, for example, in U.S. Pat. No. 3,771,634 entitled "Surface Pattern Stylus Board" for inventor R. T. Lamb and issued on November 13, 1973. A wrap roller 28 acts in cooperation with a drive roller 18 to hold that, or tension, the length of chart paper 20. As the length of distributed chart paper 20 passes over the stylus area 24 and toner station 26, electrographic printing is caused to take place by any suitable control device in cooperation with received informational data for displaying as printed matter on the chart paper.

The constant starting and stopping of the stepper motor 16, necessitated by automatically and/or manually imposed printing instructions, can cause an undesirable slack portion to occur in the length of distributed chart paper 20. The slack can occur elsewhere, but generally, as indicated by dotted line 30, it exists between the roll of chart paper 14 and the stylus area 24. This slack may be caused by improper tensioning of either the chart paper roll 14 or the length of distributed chart paper 20 or both. The slack 30 frequently occurs due to the inertia of the rotating roll of paper. As the drive roller 18 stops, the inertia oof the drive components, including the paper roll, will cause an excess amount of paper to be distributed from the paper roll 14. This occurs because the paper roll 14 rotates, or is caused to rotate, past its intended stop position. Also, the stepper motor 16, which drives the drive roller 18, may sometimes override its stop position. If this happens, the stepper motor 16 will reverse back to its electrically detented position. A slight excess of distributed paper would then result as described hereinbefore and an excess of paper is delivered from the paper roll 14 as indicated by the slack portion 30 shown in FIG. 1.

In addition, lost motion can occur in the interacting of mechanical linkage throughout the chain of paper drive and control mechanisms in the instrument resulting in slack in the chart paper. For example, when the stepper motor 16 stops at its electrically detented position, the drive roller 18 ideally is also supposed to stop. However, the chart paper roll 14 has rotational inertia, as explained earlier, and, therefore, continues to turn. Consequently, before the chart paper roll 14 stops, an excess amount of chart paper is payed out off the roll 14 and is shown in that extended position by the slack portion 30. However, as the stepper motor 16 is reenergized to drive the roller 18, the slack portion 30 of the length of chart paper 20 is rapidly taken up before any drag exerted by the chart paper roll 14 can come into effect. As is easily appreciated such an occurrence will result in overprinting and can distort the characters printed on the length of the chart paper 20 making them unacceptable.

Figure 2:
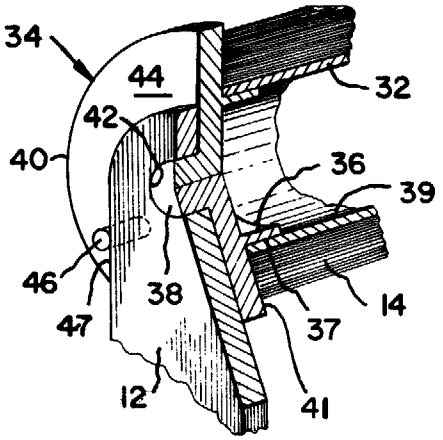
FIG. 2 is a partial sectional view of a rolled paper holding device taken in perspective along line 2—2 of FIG. 1.

The roll of recording paper 14 generally is wound on a supporting core 32, which may typically be made of cardboard, and is substantially coaxially mounted to a pair of end caps 34. The end caps 34 are substantially identical to each other and, therefore, for ease of illustration, the description and function of one is identical to the other. As best seen in FIG. 2, end cap 34 comprises a hub 36, a boss 38 and a flange 40. Specifically, the supporting core 32 of paper roll 14 is slipped over hub 36 of end cap 34. The flange shoulders against the edge of the paper roll, thereby keeping the paper aligned. The boss of end cap 34 is then inserted into a complementing aperture 42 in upright support members 12 and 12'. The boss 38 is sized so that it may rotate within the aperture 42.

On a surface 44 of end cap 34 which faces away from the end of the paper roll 14, there is located a protruding member 46 which effectively operates as a rotational stop pin. The protruding member 46 is positioned so that it can abut against the edge 47 of upright support members 12 and 12' the importance of which will be more fully explained hereinafter. The outer diameter of the hub 36 is slightly smaller than the inner diameter of the paper supporting core 32. As the stepper motor 16 is energized thereby causing the drive roller 18 to drive the length of chart paper 20 forward, slippage occurs between the paper supporting core 32 and the end cap hub 36 because of the differences in their diameters. Therefore, the roll of chart paper 14 is free to rotate on the hub 36 of end cap 34 and substantially about axis 35. The end cap 34, however when the chart paper is being payed out, remains stationary in the support member 12 because of the abutment contact of the protruding member 46 with the edge 47 of upright support members 12 and 12'.

Figure 3:
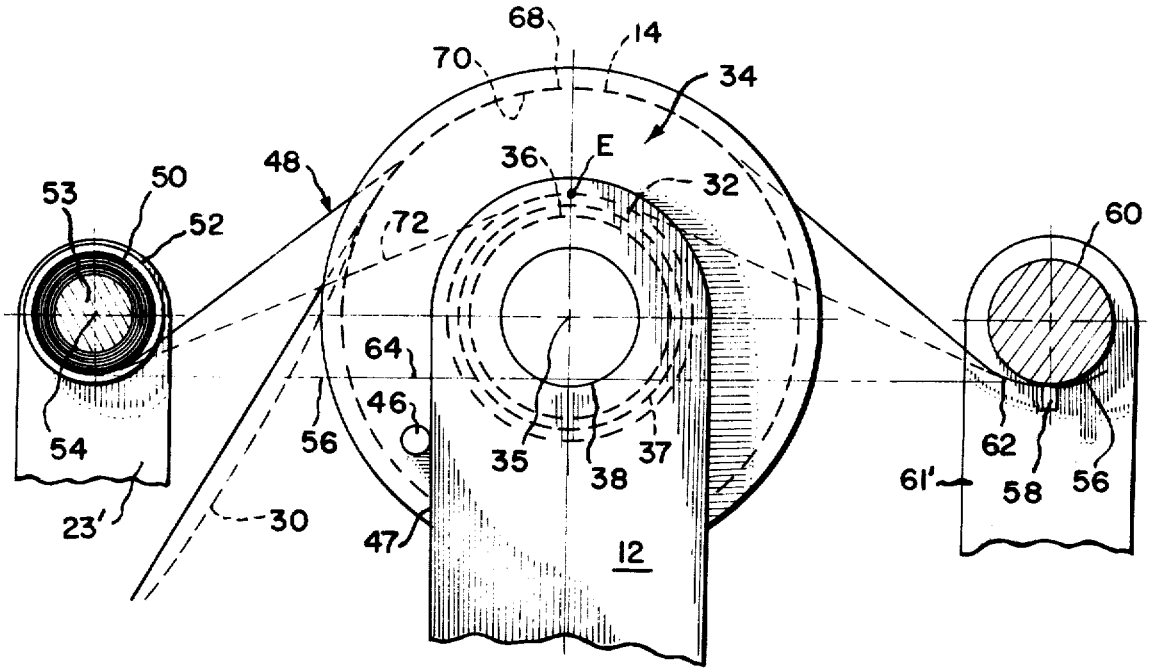
FIG. 3 is an enlarged detailed partial view showing the paper tensioning device of FIG. 1.
Figure 5:
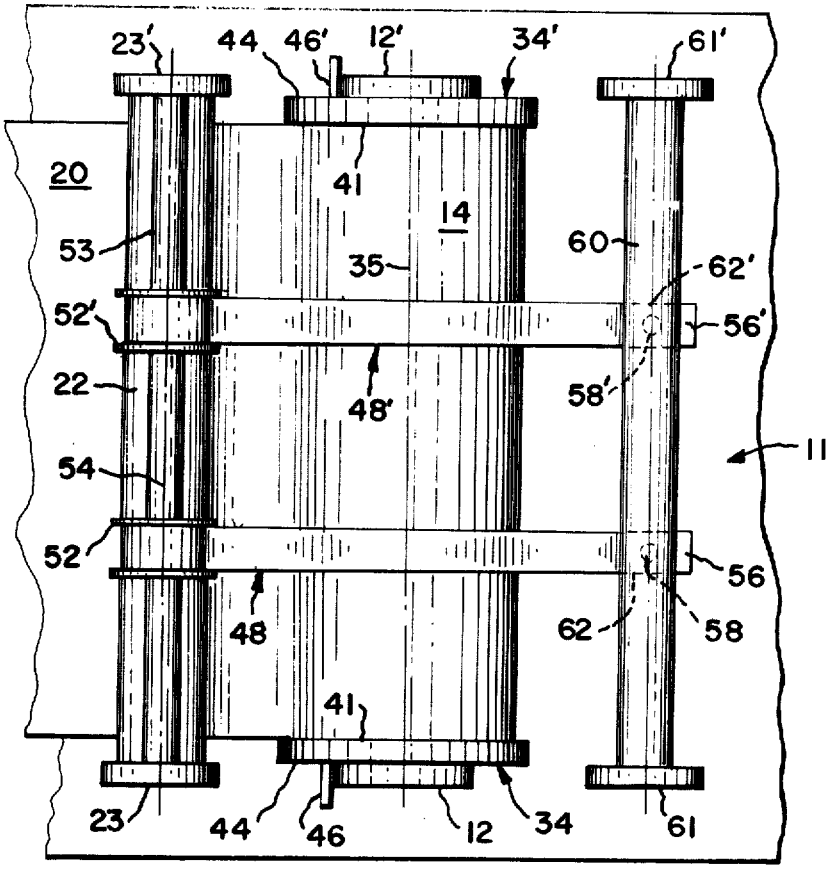
FIG. 5 is a partial top plan view of the embodiment of FIG. 1.

A pair of constant-force springs 48 and 48' are employed to tension, remove backlash and eliminate slack from the payed out length of recording paper 20. These constant-force springs may be readily purchased from a number of sources such as, for instance, the Hunter Spring Co. of Lansdale, Pennsylvania and the Associated Spring Corp. of Bristol, Connecticut. In order to make the description of the function of the constant-force springs 48 and 48' more readily understood, only one spring 48 will be fully described. The second spring 48' has exactly the same function as spring 48 and its component parts are exactly the same. The component parts of spring 48' will match the parts of spring 48 and will be identified in the drawings by the same number with a prime mark. The constant-force spring 48 is generally comprised of a flat strip of spring steel which has been subjected to a forming operation, so that once manufactured it has a natural state that forms a tightly wound spiral 50. The tightly wound spiral 50, as best shown in FIG. 3, is then wrapped, for instance, on spool 52 which has a radius that is slightly greater than the internal radius of the spiral 50. The spool 52, which is best seen in FIG. 5, is appropriately supported on axial mount 53 extending between base supports 23 and 24' to freely rotate about an imaginary axis 54 concentric with axial mount 53.

Figure 4:
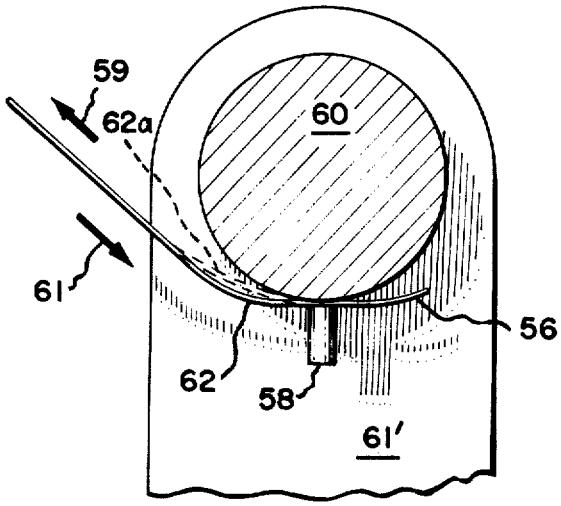
FIG. 4 is an enlarged view of the mounting end of the paper tensioning device of FIGS. 1 and 3 according to the principles of the invention showing the positions of the mounting end under start and stop conditions exerted by a driving mechanism

The axis 54 about which spool 52 rotates is preferably parallel to the axis 35 about which the core 32 rotates. The free end 56 extends out from the spool 52 a predetermined distance and is anchored by suitable means, such as pin 58, to a substantially stationary mount 60, as best seen in FIG. 4. The mount 60 extends between base supports 61 and 61' and has an axis which is substantially parallel to axes 35 and 54. The constant-force spring 48 characteristically has a memory which causes the extended portion of the spring to return to its coiled spiral state. The positional relationship that the mount 60, the spring spool 52 and the paper roll 14 each have to the other serves a special function. Each is so positioned that when a portion of the spring 48 extended from the spool 52 and is anchored by pin 58 at its free end 56, a hooked portion 62 will result at the mount 60. The significance of this relationship will be more fully explained hereinafter.

A more thorough explanation of the construction and action of the constant-force spring may be found on pages 161–170 of "Spring Design and Application", edited by Nicholas P. Chironis and published in 1961 by McGraw-Hill Book Company, Inc. of New York and on pages 152–154 of "Mechanical Springs" by A. M. Wahl and published in 1963 by McGraw-Hill Book Company, Inc. of New York.

Referring to FIG. 3, it will be readily seen that a tangent line 64 struck from the outermost convolution 66 of the constant-force spring 48 to the mounting position, such as at pin 58, of free end 56 intersects the outer perimeter 37 of the hub 36. Consequently, the extended portion of the constant-force spring 48 located between the spool 52 and the mount 60 at the free end 56 will contact the roll of paper 14 along a portion of the periphery of the roll of paper. A curved portion 68, which corresponds to the curvature of a portion of chart paper roll perimeter 70, which it engages, will thereby be formed. It should be appreciated that the constant-force spring will provide the advantages of this invention provided the spring forcefully rests against the paper disposed between the spool 52 and the mount 60. Therefore, for example, in FIG. 3, this relationship can exist providing the paper at its lowest illustrated vertical position at point E is above the imaginary tangent line 64.

It is obvious that as more and more paper 20 is dispensed from the roll 14 it will become continually smaller and smaller until such a time is reached when all of the paper is gone from the roll 14 and only the supporting core 32 remains. The constant-force spring must, therefore, compensate for the dimensional differences by automatically recoiling back onto itself at the spiral 50 supported by spool 52. This action provides a substantially constant force to act on the roll of chart paper 14 at the curved portion 68 of the spring 48 regardless of the diameter of the chart paper roll. Even as the roll of chart paper 14 nears the point of being completely depleted, the constant-force spring 48, as represented by broken line 72 in FIG. 3, continues to rewind back onto itself. It is readily seen that a steady and even force will be exerted against the paper regardless of the paper roll diameter.

It will be appreciated that if the paper was wound onto the roll in a perfectly straight manner and a pull on the paper was exerted in a plane perpendicular to the axis of the roll, the paper would be delivered from the roll as straight as it was wound thereon. However, if any contrary steering forces exist which act on the paper it may be delivered from the roll in an unacceptable manner; e.g., it will run off the roll at something less than a right angle. This action can disrupt any printing taking place at the printing station and may also cause the paper to jam and/or tear.

Some of the contrary steering forces which may exist to act on the roll of paper 14 are (1) the drive roller 18 will adversely steer the length of paper 20 if the paper roll does not slip slightly; (2) frictional forces which exist in the stylus area 24 may adversely steer the paper 20, and (3) if the wrap roller 20 is not properly aligned it may act to adversely steer the paper.

The friction forces generated by the constant-force spring 48 are greater than any, or all, of the contrary steering forces exerted on the length of chart paper 20, such as those which may be exerted, for example, by the rollers 18 and 22 or the printing stylus 24. This condition prevents the chart paper from skewing to one side or the other of the chart paper roll 14. It will be appreciated that in most instances a pair of constant-force springs, equally spaced from the center of the paper roll, will provide more than satisfactory results when paper rolls of small or normal sizes are considered for printing instruments of the type hereinbefore mentioned. However, it occasionally becomes desirable to use paper rolls which are perhaps wider and heavier than the normal rolls. It has been found that in these instances the use of more than two springs will provide the necessary friction forces to provide uniformity to the printing results.

Referring now to FIG. 4, the hooked portion 62 of the constant-force spring 48 is illustrated in the position it assumes when secured, such as by pin 58, to the mount 60. The roll of chart paper 14 is continually being started and stopped by the stepper motor 16. Consequently, if no corrective measures are taken an excess amount of paper, as hereinbefore mentioned, may come off the roll 14. This happens because the roll of paper 14 rotates past its intended stop position. The constant-force spring 48, as set forth and described by this invention, is utilized to overcome the tendencies of the paper roll to rotate past its stop position. It does this by exerting a frictional force against the perimeter 70 of the paper roll 14.

If, for instance, the paper roll 14 is rotating in a forward manner, a force will be acting against the constant-force spring 48 which tends to cause the hooked portion 62 to straighten out, as indicated by broken line **62*a* in FIG. 4, in the direction of arrow 59. However, once the paper roll 14 has positively stopped any forward rotational movement, the portion of straightened spring illustrated by line 62*a* returns to the relaxed hooked formation indicated by solid line 62 and, in returning, exerts a force in the direction of arrow 61. The frictional forces exerted by the extended portion of spring 48 on the paper roll perimeter 70 in the direction of arrow 61 automatically causes the paper roll 14 to rotate backward about axis 35. The slack portion of chart paper 30 thereby is wound back onto the roll 14. It will be appreciated that the spring end 56 can be affixed by the pin 58 to the mount 60 anywhere about the perimeter of the mount 60 provided the hereinbefore described relationship is maintained. By referring to FIGS. 2 and 3 a more detailed understanding of the relationship protruding member 46 has to the constant-force spring can be described. It will be readily seen in FIG. 2 that the diameter of the boss 38 is substantially smaller than the diameter of the hub 36. When the paper is being fed off the roll through the various stages necessary for printing, the paper roll is, of course, rotating in a forward manner. The end caps 34 will rotate with the paper roll 14 until the protruding member 46 engages the stop surface 47. In this mode the rotation is taking place about the diameter of the boss 38. When the rotation of the end cap is stopped by the protruding member the rotation will be about the diameter of the hub 36. The frictional forces exerted by rotating around the larger hub 36 causes a drag to be exerted against the length of chart paper 20 and, therefore, aids in tensioning. However, when the paper roll 14 stops its forward motion, a slight amount of slack 30 may have been payed out off the paper roll 14. The hooked end 62 of constant-force spring 48, as just explained, causes the paper roll 14 to rotate backwards thereby taking up the slack. The hooked portion 62 of the spring 48 can only do this because the paper roll 14 is once again rotating about the smaller boss 38**, and its attending lesser frictional forces.

Figure 7:
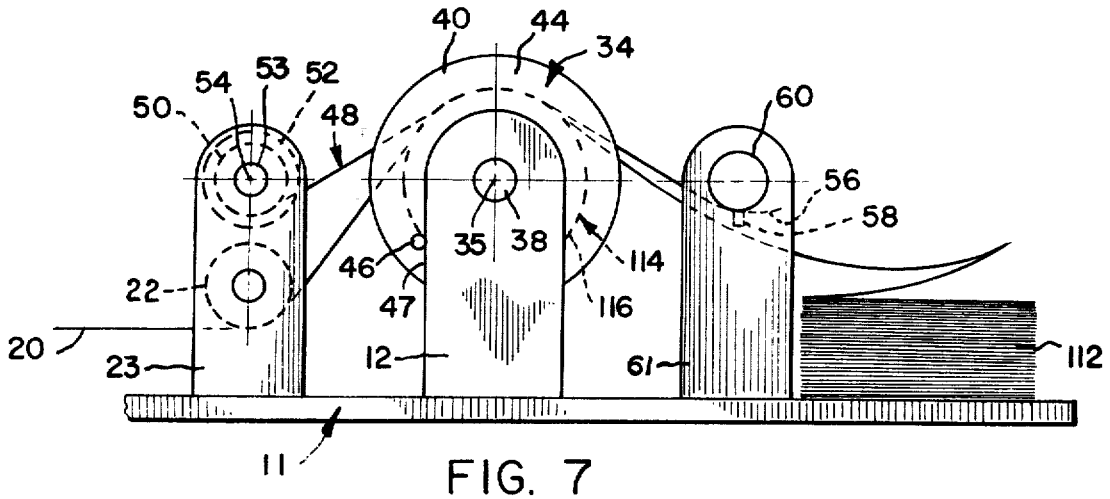
FIG. 7 is a schematic diagram of the illustrated embodiment of FIG. 6.
Figure 6:
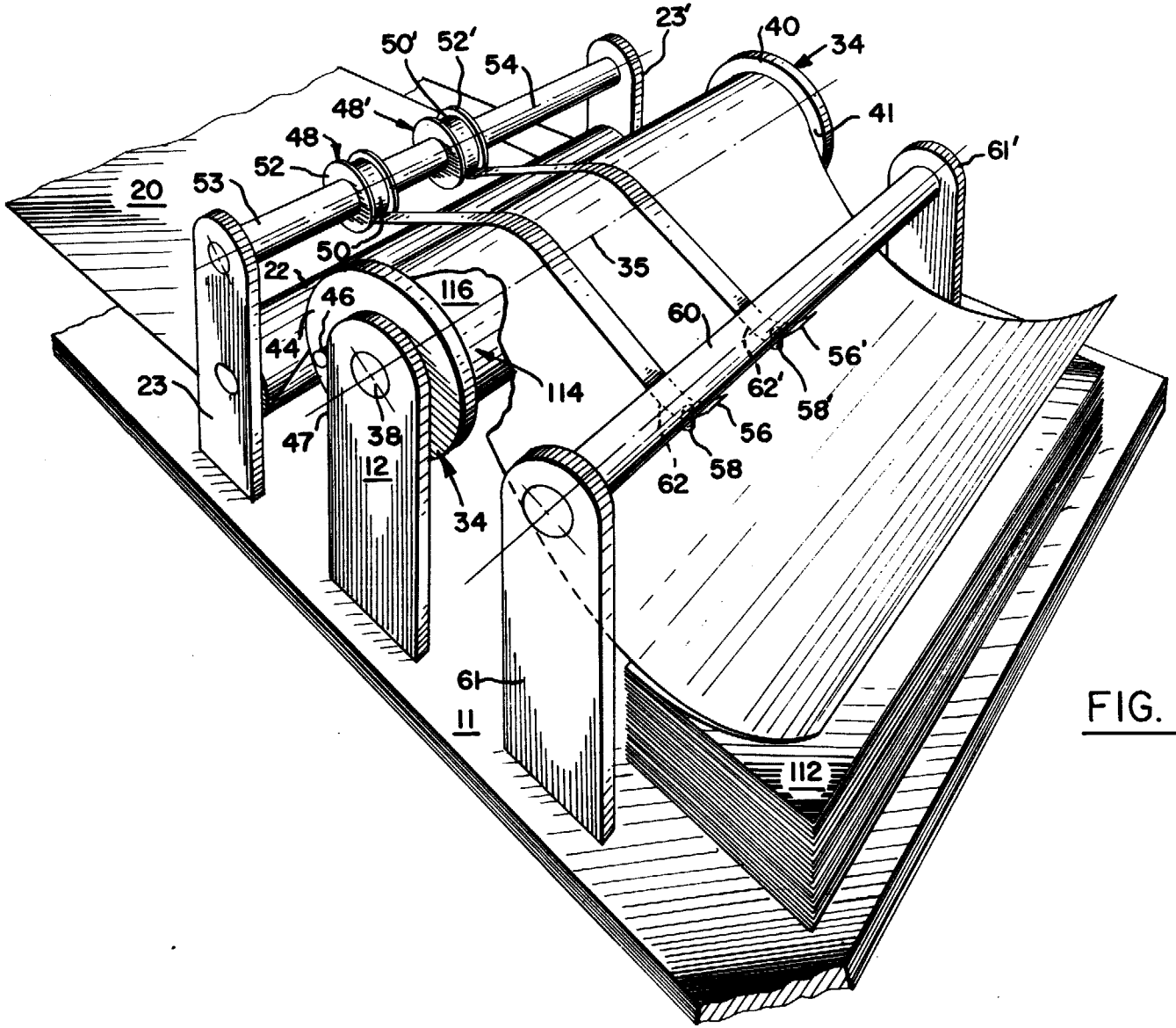
FIG. 6 is a perspective view of a modified embodiment of the embodiment of FIG. 1 according to the principles of the present invention.

A modified embodiment of the invention, illustrated in FIGS. 6 and 7 is adapted to utilize a stack of fan-fold paper 112 preferably by merely substituting a tube 114, as seen in FIG. 6, in place of the roll of chart paper 14. Fan-fold paper may be described as a continuous form of paper which is folded back onto itself usually many numbers of times and whose pages are delineated by either folds or by perforations at the fold areas. The tube 114 is slipped over the beforementioned hub 36 of end cap 34. The outer diameter of the tube 114 could, of course, vary in size from the measurement of a full roll of chart paper to the diameter of an empty roll. Also, the periphery 116 of the tube 114 can, for example, be formed of a relatively smooth substance, such as some kinds of plastic. Although the properties of plastic are preferred, an empty rolled paper core would suffice to act as spindle 114.

The operation of this modified system functions exactly the same as the one explained hereinbefore with respect to FIG. 1. In this alternate embodiment, only the additional tube 114 with a pair of end caps 34 inserted therein as placed in the supporting member 12 so that the fan-fold paper 112 may be fed over the tube 114 between the flanges 40 of end caps 34. The end caps 34 are spaced apart a predetermined amount by the tube 114 so that the distance between inside surfaces 41 of the flanges 40 which contact the paper is essentially the same as the width of the paper 112. It is readily seen that if the width of the paper is the same as the distance between the inside surfaces 41 of the flanges 40 and that if paper is placed between these flanges the paper will make contact with the flange surfaces 41. In so doing, the paper is kept in a perpendicular relationship to the flange surfaces 41 and is therefore fed from the stack 112 and over the tube 114 without becoming skewed. Further, the protruding member 46, as explained hereinbefore, stops any unwanted forward rotation of the end caps 34. In so doing it prevents the portion of fan-fold paper 112 which is engaged with the tube 114 from climbing the inside surfaces 41. If the end caps 34 were allowed to rotate with the tube 114 the paper 112 could become dislodged from the tube. The engagement of the protruding member 46 with the support member 12 prevents this by stopping forward rotation of the end cap 34.

The similarity in the handling and control of the rolled chart paper 14 and fan-fold paper 112 is great. By passing a length of the fan-fold paper 112 over a tube 114, the handling conditions regarding rolled chart paper are closely duplicated. The constant-force spring 48 will, therefore, engage the fan-fold paper which engages the periphery 116 of the tube 114 much the same as it does the periphery of the roll of chart paper.

While there have been described and preferred embodiments of this invention at the present time, it should be obvious to those skilled in the art that changes and modifications can be made thereto without departing from the spirit and scope of the invention.

It is claimed:

1. An electrographic printer recording medium tensioning device, comprising:

a base;

an electrographic recording medium support device carried by the base and having a curved surface for contacting one surface of the recording medium substantially across its width;

at least one constant-force spring having first and second ends and a connecting portion therebetween, the first and second ends being mounted to said base to dispose the connecting portion tp bear constantly and evenly against the other surface of the recording medium forcing it into contact with the curved surface of the recording medium support device for tensioning the recording medium.

2. In an electrographic printer, recording paper control apparatus for negating the effect of contrary movement forces exerted on recording paper being distributed by a printer drive mechanism within the electrographic printer while printing on select portions of the recording paper, comprising:

a base;

first means mounted to slide base for supporting recording paper;

a pair of constant-force springs, each spring having a coiled end, a free end and an intermediate segment connecting the coiled end with the free end; and second means mounted to said base for carrying said constant-force springs by disposing the intermediate segment of each spring for each segment to respectively engage a portion of a surface area of the recording paper supportable by said first means so that a constant force is exerted by the intermediate segment of each spring on the surface of recording paper to negate the effect of contrary movement forces exerted on recording paper being driven through the electrographic printer during printing upon the paper.

3. The control apparatus as described in claim 2, wherein said first means is a cylindrical member having a pair of end caps detachably affixed thereto.

4. The control apparatus as defined in claim 3, wherein the end caps each define abutment walls for providing edge alignment to recording paper.

5. The control apparatus as described in claim 2, wherein said second means comprise a first fixture for mounting the coiled end of each respective spring and a second fixture spaced apart from said first fixture for mounting the free end of each respective spring to dispose the intermediate segment across the first means for supporting recording paper.

6. The control apparatus as defined in claim 5, wherein each of said constant-force springs affixed to said second fixture and extending outwardly toward the coiled end define a curved path closely proximate the second fixture.

7. A recording material tensioning device for use in an electrographic printer of the type wherein a cylindrical roll of recording material wound on a central core is distributed by a printer drive mechanism through the various stages required for printer, comprising:

a base;

first means mounted to said base for supporting the roll of recording material about its central core;

at least a pair of constant-force springs, each spring having a coiled end, a free end and an intermediate segment connecting the coiled end with the free end;

second means affixed to said base for mounting the coiled end of each respective constant-force spring; and third means mounted to said base at a location remote from said second means for mounting the free end of each respective constant-force spring to dispose the intermediate segment of each spring to contact the outer surface of a roll of recording material supportable by said first means and to exert a constant force thereon independent of the varying diameter of a roll of recording material.

8. The material tensioning device as described in claim 7, wherein said first means includes a pair of end caps, each cap defining thereon a hub for removable engagement with opposite ends of the central core of a roll of recording material, and a wall extending outwardly from the hub engaging the central core for abutment with the edge of recording material.

9. The material tensioning device as described in claim 8, wherein the hub of each respective end cap is dimensioned to enable slippage to occur between the central core of the recording material and the hub.

10. The material tensioning device as described in claim 7, wherein said second means includes a cylindrical body having an axis substantially parallel to the axis of the central core of the cylindrical roll of recording material.

11. The material tensioning device as described in claim 10, wherein the coiled end of each respective constant-force spring is substantially free to rotate about said cylindrical body.

12. A tensioning device for use in an electrographic printer of the type wherein a continuous segment of fan-fold recording material is distributed by a drive mechanism through the various printer sections required for printing on select portions thereof, comprising:

a base;

first means mounted to said base for supporting a portion of a continuous segment of fan-fold recording material;

at least a pair of constant-force springs, each spring having a coiled end, a free end and an intermediate segment connecting the coiled end with the free end;

second means affixed to said base for mounting the coiled end of each respective constant-force spring; and third means mounted to said base remote from said second means and disposed to secure the free end of each respective constant-force spring, so that each intermediate segment engages at least some portion of the fan-fold recording material supportable by said first means to exert a constant force thereon.

13. The tensioning device as described in claim 12, wherein said first means comprises a cylindrical member having a pair of end caps.

14. The tensioning device as described in claim 13, wherein said cylindrical member is tubular in shape and said end caps are detachable from said tubular member.

15. The tensioning device as described in claim 13, wherein said end caps have flanges defined thereon for engagement with an edge of the supportable segment of fan-fold material providing edge alignment thereto.

16. The tensioning device as described in claim 13, wherein said second means is annular in shape and has an axis which is substantially parallel to the axis of said cylindrical member.

17. The tensioning device as described in claim 16, wherein the coiled end of each respective constant-force spring is substantially free to rotate about said annularly shaped member.

18. A method of tensioning recording material for use in electrographic printing, comprising the steps of:

loading electrographic recording material in an electrographic printer;

disposing an inner surface of the electrographic recording material over a curved surface uniformly extending wwithin the electrographic printer in a direction transverse to the movement direction of the recording material;

dispensing electrographic recording material across the curved surface and through the electrographic printer for printing upon the recording material;

exerting a constant force against the outer surface of the electrographic recording material disposed over the curved surface to force the recording material against the curved surface to tension the recording material as it moves across the curved surface thereby providing tension in the recording material during the printing process.

19. The method of tensioning recording material as defined in claim 18, wherein the step of exerting the constant force against the outer surface of the electrographic recording material includes disposing a constant force spring to bear against the outer surface of the recording material at the curved surface to force the recording material against the curved surface.

20. The method of tensioning recording material as defined in claim 18, wherein the step of loading electrographic recording material in an electrographic printer comprises placing a roll of electrographic recording paper in the printer.

21. The method of tensioning recording material as defined in claim 20, wherein the step of loading electrographic recording material in an electrographic printer comprises placing a quantity of fan-fold electrographic recording paper in the printer.

22. The method of tensioning recording material as defined in claim 20, wherein the step of disposing an inner surface of the electrographic recording paper over a curved surface includes the step of providing a roll of recording paper wherein the curved surface over which the inner surface of the recording paper is disposed comprises the outer surface of the recording paper disposed beneath the inner surface of the recording paper spirally wound on a central core.

23. The method of tensioning recording material as defined in claim 21, wherein the step of disposing an inner surface of the electrographic recording paper over a curved surface includes the step of providing a cylindrical shaped paper support for supporting the fan-fold paper and against which the constant force is exerted to tension the recording paper.

24. The electrographic printer recording medium tensioning device as described in claim 1, wherein said constant-force spring has substantially the same width throughout its entire length.

25. The electrographic printer recording medium tensioning device as described in claim 1, wherein the curved surface of said constant-force spring forms an arc having substantially the same radius of curvature as that defined by the contacted surface of the recording medium.

26. The electrographic printer recording medium tensioning device as described in claim 1, wherein one of the ends of said constant-force spring is coiled.

27. The electrographic printer recording medium tensioning device as described in claim 1, wherein the length of the connecting portion of said constant-force spring between the first and second ends thereof is variable.

* * * * *

UNITED STATES PATENT AND TRADEMARK OFFICE

CERTIFICATE OF CORRECTION

PATENT NO. : 4,004,749

DATED : January 25, 1977

INVENTOR(S) : Robert F. Strange

It is certified that error appears in the above-identified patent and that said Letters Patent are hereby corrected as shown below:

Column 1, line 41, change "have only partially" to --have been only partially--.

Column 2, line 1, change "roller" to --rolled--.

Column 3, line 4, change "oof" to --of--; and
line 17, insert --also--between "can" and "occur".

Column 4, line 26, change "24'" to --23'--; and
line 43, insert --is-- between "48" and "extended".

Column 7, line 2, change "as" to --is--;
line 35, change "and" to --the--;
line 52, change "tp" to --to--; and
line 64, change "slide" to --said--.

Column 8, line 19, change "comprise" to --comprises--; and
line 34, change "printer" to --printing--.

Column 9, line 54, change "wwithin" to --within--.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*